United States Patent [19]

Higuchi

[11] Patent Number: 4,975,747

[45] Date of Patent: Dec. 4, 1990

[54] IMAGE DENSITY CONTROL BY SENSING REFERENCE DENSITY PATTERNS AT MULTIPLE POINTS

[75] Inventor: Masami Higuchi, Yokohama, Japan

[73] Assignee: Ricoh Company, Ltd., Tokyo, Japan

[21] Appl. No.: 426,686

[22] Filed: Oct. 26, 1989

[30] Foreign Application Priority Data

Nov. 4, 1988 [JP] Japan ..... 63-277421

[51] Int. Cl.[5] ..... G03G 21/00

[52] U.S. Cl. ..... 355/246; 355/214

[58] Field of Search ..... 355/214, 206, 246; 118/653

[56] References Cited

U.S. PATENT DOCUMENTS

| | | | |
|---|---|---|---|
| 4,313,671 | 2/1982 | Kuru | 355/246 X |
| 4,539,279 | 9/1985 | Murai et al. | 355/246 X |
| 4,736,223 | 4/1988 | Suzuki | 355/214 |

FOREIGN PATENT DOCUMENTS

| | | | |
|---|---|---|---|
| 0161555 | 12/1981 | Japan | 355/214 |
| 0076563 | 5/1982 | Japan | 355/214 |
| 0240574 | 10/1988 | Japan | 355/246 |
| 1559341 | 1/1980 | United Kingdom | 355/214 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

An image density control for an electrophotographic copier uses a first and a second reference density pattern having a comparatively low and a comparatively high reference density, respectively. After latent images of the first and second reference density patterns have been formed on a photoconductive element, a potential sensor senses their potentials. In response to the sensed potentials, the potentials of the latent images are set at their predetermined target value. These target values are variable as desired.

8 Claims, 5 Drawing Sheets

IMAGE DENSITY CONTROL BY SENSING REFERENCE DENSITY PATTERNS AT MULTIPLE POINTS

BACKGROUND OF THE INVENTION

The present invention generally relates to an image forming apparatus of the type forming a latent image on a photoconductive element, or image carrier, by an electrophotographic procedure and developing the latent image by a toner. More particularly, the present invention is concerned with an image density control installed in such a type of apparatus for controlling image density on the basis of the potential of a latent image of a reference density pattern having a reference density or the density of a toner image thereof.

An electrophotographic copier or similar image forming apparatus has an operation board which generally includes a density control section, so that a person may select a desired image density. A problem heretofore pointed out is that even if the density control section is manipulated to set up a reference image density, the image density sequentially changes due to the aging of a photoconductive element and lamp, shortage of toner, changes in a bias voltage for development, etc. In the light of this, it has been customary to form a latent image of a reference density pattern on the surface of a photoconductive element outside of a document image exposing area, develop the latent image by a toner, sense the density of the resulting toner image on the photoconductive element or that of the toner image transferred to a paper sheet by a density sensor, and then correct the image density in response to the sensed density. With this kind of approach, it is possible to form a toner image of the reference density pattern on the photoconductive element by an ordinary image forming sequence. Further, the reference density of the reference density pattern and, therefore, the image density is freely selectable. Specifically, the image density is adjusted by controlling the outputs of a main charger, lamp regulator and bias voltage source for development, or by on-off controlling a toner supply unit.

Measuring the potential of a latent image representative of a reference density pattern and so controlling the amount of charge on or the amount of exposure of a photoconductive element as to set up a target potential is a known implementation for image density control. However, since the target potential has customarily been fixed, the image density has suffered from the influence of irregular illumination on the reference density pattern, uneven painting of the reference density pattern, etc.

SUMMARY OF THE INVENTION

It is therefore an object of the present invention to provide an image density control for an image forming apparatus which provides images with adequate density stably.

It is another object of the present invention to provide a generally improved image density control for an image forming apparatus.

An image density control for use in an image forming apparatus for controlling a density of a toner image of an electrostatic latent image which is formed on an image carrier and representative of a document image of the present invention comprises at least a first and a second reference density pattern each having a different reference density, a potential sensor for sensing potentials of electrophotographic latent images of the first and second reference density patterns which are formed on the image carrier, and a potential setting device for setting, in response to the potentials sensed by the potential sensor, each of the potentials of the latent images of the first and second reference density patterns at a predetermined target value.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
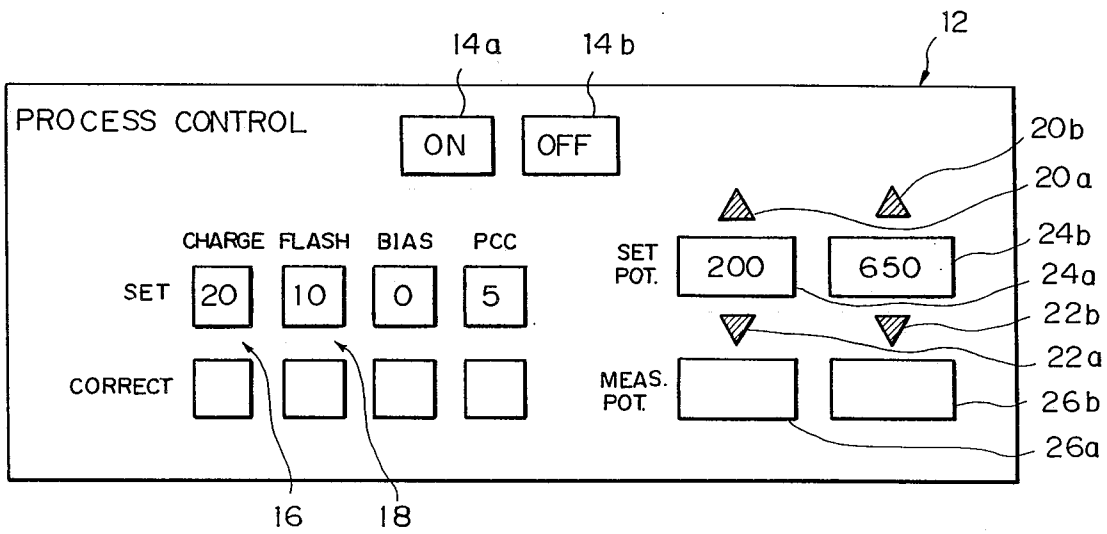
FIG. 1 is a fragmentary plan view of a display section included in an operation board of an electrophotographic copier which belongs to a family of image forming apparatuses to which the present invention is applicable.

Referring to FIG. 1 of the drawings, there is shown a display section which forms a part of an operation board 12 of an image forming apparatus to which the present invention is applicable. The image forming apparatus is implemented as an electrophotographic copier by way of example. As shown, the display section has an ON/OFF select switches **14*a* and 14*b* for switching on and off process control as needed, and a charge step display 16 and a flash step display 18 respectively representative of a particular amount of charge and a particular amount of exposure being selected and each being variable in thirty-three consecutive steps. Numerical values appearing in the upper part of the individual displays 16 and 18 are representative of initially set values, while numerical values in the lower part are representative of the amounts of shift available with the process control. UP switches 20*a* and 20*b* and DOWN switches 22*a* and 22*b* are accessible to increase and decrease the target potentials of electrostatic latent images each being associated with respective one of two different reference density patterns, as will be described. The switches 20*a*, 20*b*, 22*a* and 22*b* are individually manipulable to change the associated potential on a 10 volts basis. The selected target potentials are indicated on set potential displays 24*a* and 24*b*. Displays 26*a* and 26*b*** are adapted to show measured potentials of the individual reference density patterns which will be described.

Figure 2:
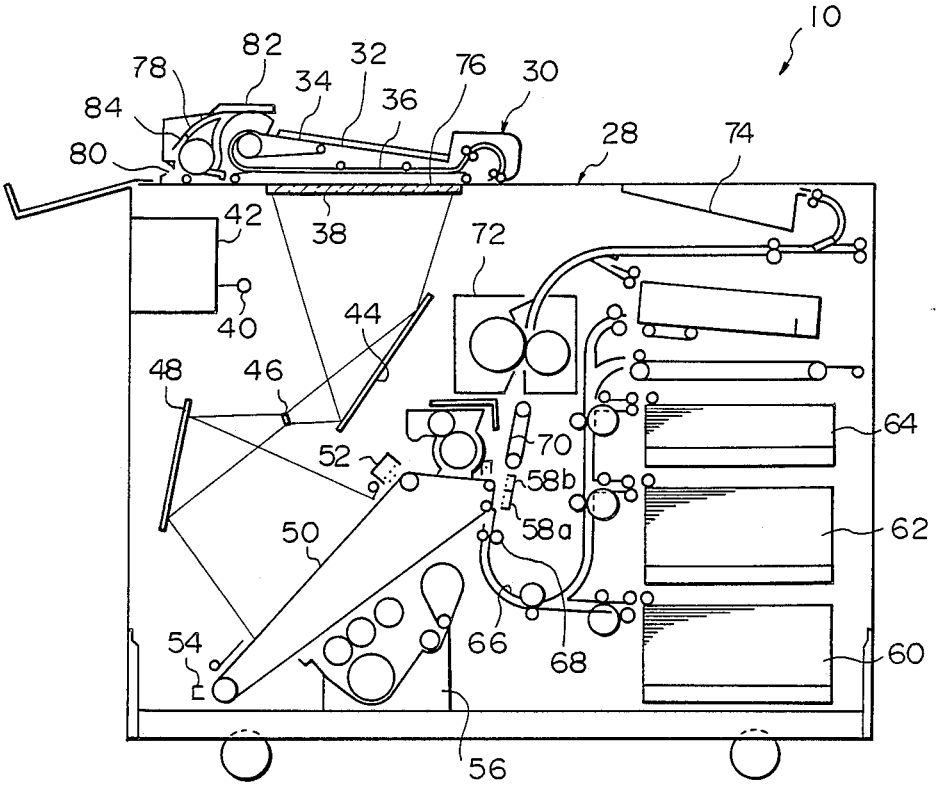
FIG. 2 is a sectional side elevation of the copier shown in FIG. 1.

Referring to FIG. 2, the copier with the operation board 12 is shown and generally designated by the reference numeral 10. The copier 10 has a copier body 28 and a recycling document feeder (RDF) 30. To start a copying operation, the operation board 12 is manipulated to enter desired copying conditions, and then a start button, not shown, is pressed. The following description will concentrate on an RDF mode operation by way of example. The RDF 30 has a document tray 32 which is loaded with an original document. A belt 34 feeds the document from the tray 32 to a glass platen 38 over a document transport path 36. On reaching the glass platen 38, the document is illuminated by a flash lamp 40 over its entire surface. A power source 42 is associated with the flash lamp 40 and is loaded with a charge beforehand by a control, which will be described, so as to flash at a predetermined timing.

A reflection from the document is steered by a first mirror 44, a through lens 46 and a second mirror 48 to reach a photoconductive element 50 which is implemented as a belt. The photoconductive element 50 has been uniformly charged by a main charger 52 and, therefore, a latent image is electrostatically formed thereon by the imagewise exposure. After an eraser 54 has removed the charge from unnecessary portions of the latent image on the belt 50, a developing unit 56 develops the latent image to produce a toner image. The toner image is transported to an image transfer station to be transferred from the belt 50 to a paper sheet by a transfer charger 58*a*. The paper sheet carrying the toner thereon is separated from the belt 50 by a separation charger 58*b*. It is to be noted that the paper sheet is fed from any of paper trays 60, 62 and 64 to a register roller 68 over a transport path 66 and, at a predetermined timing, from the register roller 68 to the transfer station into register with the toner image. The paper sheet with the toner image is transported by a belt 70 to a fixing unit 72 for fixing the toner image. The paper sheet coming out of the fixing unit 72 is discharged to a copy tray 74.

The document having been fully illuminated is driven away from the glass platen 38 by a belt 76, and then it is returned to the document tray 32 by a discharge roller 78. This roller 78 is rotatable in opposite directions as needed. Specifically, when it is desired to discharge the document onto the tray 32 in the same position as the initial position, the discharger roller 78 will be reversed after the travel of the trailing edge of the document away from a selector pawl 80 so as to route the document through a forward transport path 82. When it is desired to discharge the document upside down, the discharge roller 78 is continuously driven forward to discharge the document along a reverse transport path 84.

Figure 3:
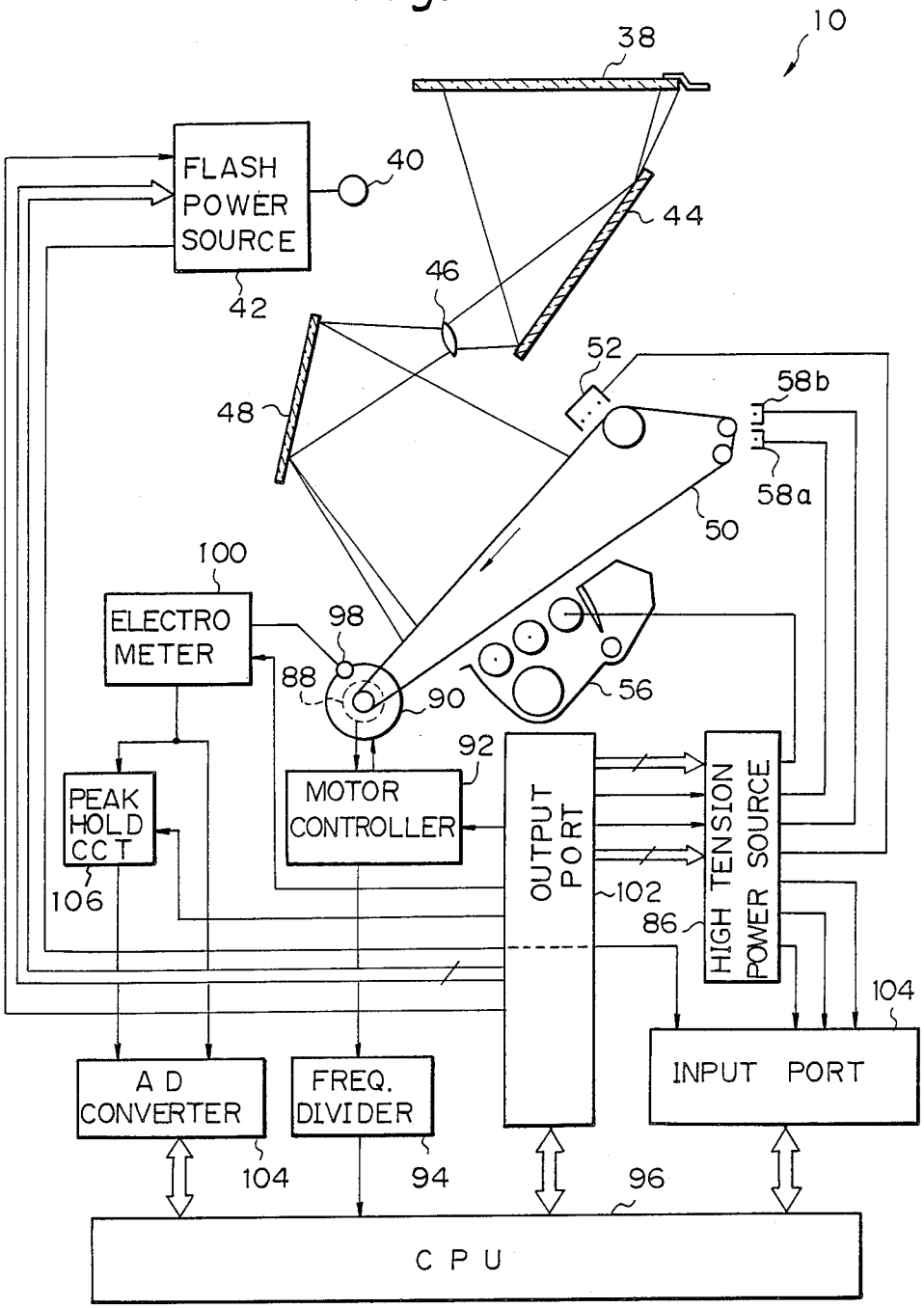
FIG. 3 is a schematic block diagram showing a preferred embodiment of the image density control embodying the present invention.

FIG. 3 is a schematic block diagram showing an image density control embodying the present invention. In the illustrative embodiment, two different reference density patterns are located on the glass platen 38 ahead of the leading edge of a document. The flash lamp 40 illuminates the two reference density patterns so as to expose the belt 50 to a reflection from the reference density patterns, whereby potential patterns or latent images of the reference density patterns are formed on the belt 50. The potentials of the latent images are measured to control a high-tension power source 86 and the flash power source 42, so that the potentials of the patterns are controlled to predetermined values.

Specifically, before the start of copying operation, a belt motor 88 is energized to rotate the belt 50. An encoder 90 is provided integrally with the motor 88, while a motor controller 92 senses output pulses of the encoder 90 to drive the motor 88 at a constant speed. A frequency divider 94 divides the frequency of the encoder pulses and delivers the resulting pulses to a CPU (Central Processing Unit) 96. By counting such pulses, the CPU 96 supervises the copying sequence and process control. The belt 50 is uniformly charged by the main charger 52 and then advanced to an exposure station. Before imagewise exposure, the flash power source 42 is loaded with a predetermined charge by a charging signal. When the belt 50 arrives at the exposure station, the power source 42 energizes the flash lamp 40 to illuminate a document which is laid on the glass platen 38, thereby forming an electrostatic latent image on the belt 50. Latent images associated with the two reference density patterns are formed on the belt 50 together with the latent image of the document. A potential sensor 98 and an electrometer 100 read the instantaneous potentials of the latent images which are representative of the reference density patterns.

Figure 4:
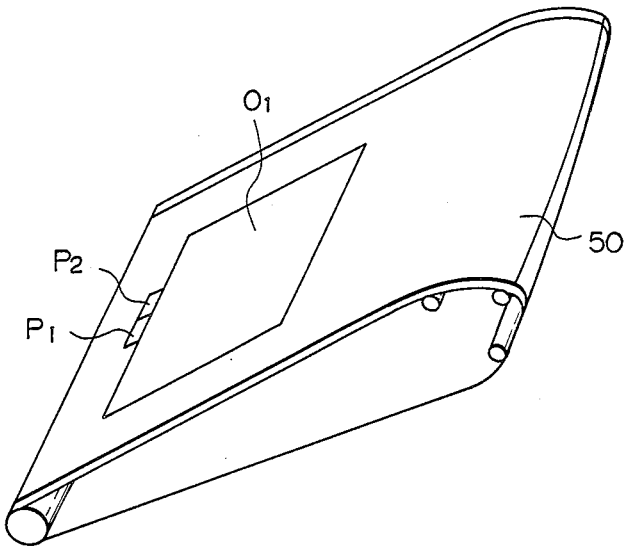
FIG. 4 is a perspective view of a photoconductive element on which a document image and reference density patterns are formed.
Figure 5:
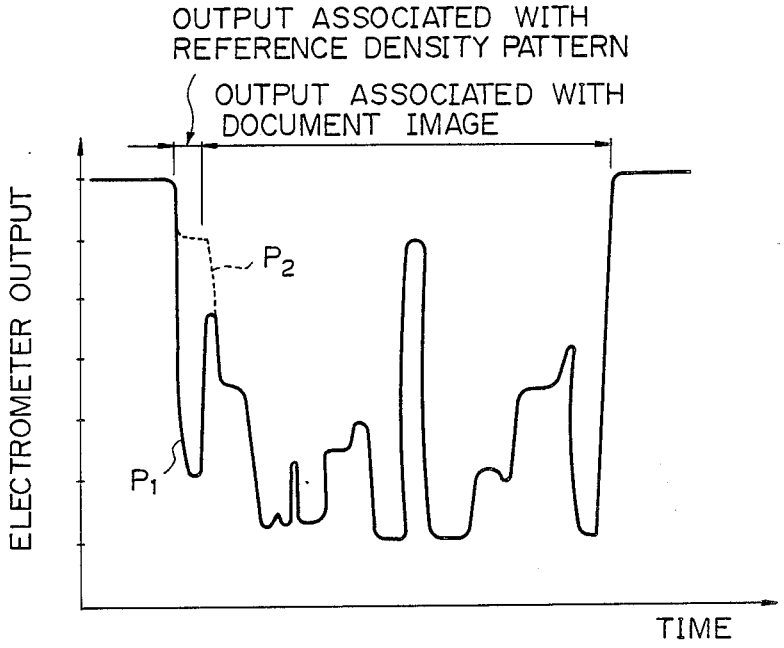
FIG. 5 is a graph representative of a relationship between the output of an electrometer and the latent images of document image and reference density patterns.
Figure 6:
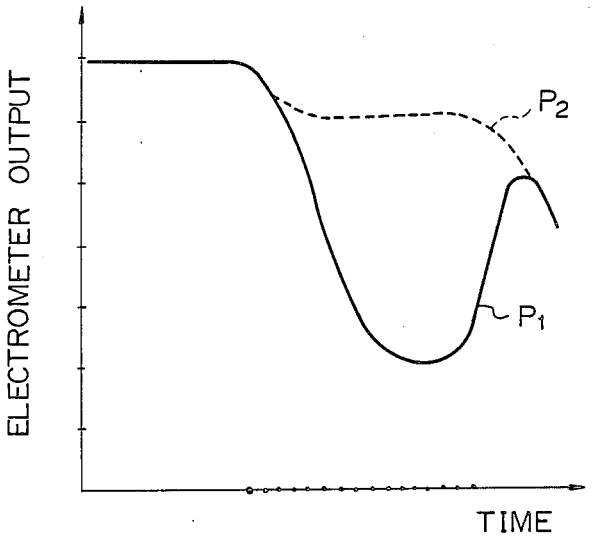
FIG. 6 is a graph showing a part of FIG. 5 in an enlarged scale.

FIG. 4 shows the belt 50 carrying thereon the latent image of the document and the latent images of the two reference density patterns. Specifically, a latent image $P_1$ is representative of a first pattern having a comparatively low reference density and is formed at the center of the belt 50. A latent image $P_2$ is representative of a second pattern having a comparatively high reference density and adjoins the latent image $P_1$. The latent images $P_1$ and $P_2$ are about 16 millimeters wide each. The latent image of the document is labeled $O_1$ in the figure. The potential sensor 98 is made up of two sensors in order to measure the potentials of both the first and second patterns. An output port 102 switches over such two sensors. In response to the outputs of the potential sensor, or sensors, 98, the electrometer 100 measures the potentials. Output data of the electrometer 100 are digitized by an analog-to-digital (AD) converter 104 and then applied to the CPU 96. FIGS. 5 and 6 show outputs of the electrometer 100 which are individually associated with the document portion and the pattern portions formed on the belt 50. In FIGS. 5 and 6, the ordinate indicates the output of the electrometer 100 while the abscissa indicates time. In FIG. 6, the dots on the time axis are representative of sampling points.

As shown in FIG. 6, the potentials of the latent images $P_1$ and $P_2$ of the reference density patterns are sampled at sixteen points. Since the latent image $P_1$ representative of the first pattern having a lower density has a potential which is close to the potential of a white area, a substantial period of time is necessary for a true pattern potential to be reached in relation to the response of the electrometer 100. Hence, the true potential of the latent image $P_1$ of the first pattern lies in the vicinity of the minimum value. For this reason, among the sampled data, the second value from the smallest value is processed as potential data associated with the latent image $P_1$. In contrast, the potential of the latent image $P_2$ of the second pattern having a higher density is close to the potential of a black area, so that a true pattern potential is reached within a short period of time. Therefore, among the sampled data associated with the latent image $P_2$, the data at eight points except for four larger data and four smaller data are averaged to provide potential data.

The amount of charge and that of exposure are varied by measuring eight potential data of the individual patterns and then averaging them. Specifically, to render the amount of charge and that of exposure variable, an output port 102 is connected to the high-tension power source 88 and the flash power source 42 by five signal lines each. This allows the amount of charge and that of exposure to be varied in thirty-two consecutive steps each. The measured data are compared with predetermined values so as to constantly control the former to the latter. In FIG. 3, the reference numerals 104 and 106 designate an input port and a peak hold circuit, respectively.

How the target potentials of the latent images $P_1$ and $P_2$ associated with the first and second reference patterns, respectively, are selected will be described. The potentials of the latent images representative of individual reference patterns for achieving optimal image density differs from one copier to another due to the scattering in illumination, painting of individual patterns, characteristics of a photoconductive element, etc. In the illustrative embodiment, the operation board 12, FIG. 1, is accessible to set up any desired target potentials. More specifically, one may select desired potentials by operating the UP switches 20*a* and 20*b* and the DOWN switches 22*a* and 22*b* while watching the displays 24*a* and 24*b*. In this sense, the UP switches 20*a* and 20*b* and DOWN switches 22*a* and 22*b* constitute potential setting means.

In summary, it will be seen that the present invention realizes a highly reliable image density control by rendering the target potentials of latent images of reference patterns adjustable on an operation board of a copier and thereby eliminating the influence of scatterings among copiers.

Various modifications will become possible for those skilled in the art after receiving the teachings of the present disclosure without departing from the scope thereof.

What is claimed is:

1. An image density control for use in an image forming apparatus for controlling a density of a toner image of an electrostatic latent image which is formed on an image carrier and representative of a document image, comprising:

at least a first and second reference density patterns each having a different reference density;

potential sensing means for sensing potentials of electrophotographic latent images of said first and second reference density patterns which are formed on the image carrier at multiple points along said patterns and for producing signals indicative of said potentials wherein at least one of said signals is indicative of a computed average of the sensed potentials of one of said reference patterns;

means for varying various conditions by comparing sensed potentials of the reference density patterns with reference potentials each being assigned to respective one of the reference density patterns; and potential setting means for setting, in response to the potentials sensed by said potential sensing means, each of the reference potentials of the latent images of said first and second reference density patterns at a predetermined target value.

2. A control as claimed in claim 1, wherein said potential setting means changes the predetermined target values.

3. A control as claimed in claim 1, wherein said potential setting means comprises a group of switches provided on an operation board of the image forming apparatus.

4. A control as claimed in claim 1, wherein said potential setting means changes image forming conditions of the image forming apparatus in response to the sensed potentials.

5. A control as claimed in claim 4, wherein the image forming conditions comprise an amount of imagewise exposure, an amount charge, an amount of toner supply, and a bias voltage for development.

6. A control as claimed in claim 1, wherein said first reference density pattern has a comparatively low reference density.

7. A control as claimed in claim 1, wherein said second reference density pattern has a comparatively high reference density.

8. A control as claimed in claim 1, further comprising optical sensing means for sensing densities of images which are produced by developing the latent images of said first and second reference density patterns and then transferring the developed images to a paper sheet.

* * * * *